US005822996A

United States Patent [19]

Sienel et al.

[11] Patent Number: 5,822,996

[45] Date of Patent: Oct. 20, 1998

[54] VAPOR SEPARATION OF VARIABLE CAPACITY HEAT PUMP REFRIGERANT

[75] Inventors: Tobias H. Sienel, Manchester; Dennis R. Pandy, South Windsor, both of Conn.

[73] Assignee: Carrier Corporation, Farmington, Conn.

[21] Appl. No.: 918,618

[22] Filed: Aug. 22, 1997

[51] Int. Cl.[6] ..... F25B 41/00

[52] U.S. Cl. ..... 62/114; 62/149; 62/160; 62/200; 62/502

[58] Field of Search ..... 62/474, 475, 502, 62/160, 114, 149, 199, 200

[56] References Cited

U.S. PATENT DOCUMENTS 2,182,318 12/1939 Newill .
4,384,460 5/1983 Vakil ..... 62/114
4,484,452 11/1984 Houser, Jr. ..... 62/160 X
4,493,193 1/1985 Fisher ..... 62/160
4,628,700 12/1986 Alsenz ..... 62/200 X

*Primary Examiner*—Henry A. Bennett
*Assistant Examiner*—Susanne C. Tinker

[57] ABSTRACT

A heat pump system has a separate outdoor coil which is mounted below the primary outdoor coil and connected in parallel with it by valves. On system start up in the heating mode, the inlet of the auxiliary coil is closed, and the outlet is opened so that compressor vacuum will boil off the more volatile, high pressure components thus filling the system. The outlet valve is then closed trapping the low pressure component in the auxiliary coil. In a second embodiment, the accumulator is utilized to assist the auxiliary coil in vacuum separation of the refrigerant blend. Variants include blocking flow through the expansion valve on start up.

7 Claims, 3 Drawing Sheets

VAPOR SEPARATION OF VARIABLE CAPACITY HEAT PUMP REFRIGERANT

TECHNICAL FIELD

This invention relates to vacuum separation of more volatile components from less volatile components of a zeotropic heat pump refrigerant blend, stored in an accumulator and/or a physically low section of the outdoor primary coil of the heat pump.

BACKGROUND ART

Current electrically-powered residential and small commercial heat pump systems have two operating and performance constraints. Mainly, they have insufficient capacity at low ambient temperatures, below about 30° F. or 40° F., so that supplemental heat sources such as electric resistance heating or fossil fuel fires must be utilized. Additionally, the temperature to which air can be heated by a heat pump working in low ambient temperatures are too low for human comfort; air below about 90° F. entering a room provides a draft chill discomfort due to the flow of the air.

It has been known to utilize multiple component refrigerants to extend the low temperature end of the useful range for heat pumps when used for heating.

DISCLOSURE OF INVENTION

Objects of the present invention include improvements in separating a low pressure component of a refrigerant blend from the remaining blend cycling in the system, and separating a low pressure zeotropic component of a multicomponent refrigerant blend simply, and without any additional major hardware components.

According to the present invention, a physically low section of an outdoor primary coil is utilized to accumulate all of the blend of a multicomponent zeotropic refrigerant blend when the system is inoperative and to store a low pressure component of the refrigerant, high pressure components of which are vaporized by compressor induced vacuum during conventional system startup. According to the invention further, the coil section has valves at either end to control its operation. In a second embodiment, the invention utilizes the suction accumulator along with the low coil section to store the low pressure component when the system operates in the heating mode.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
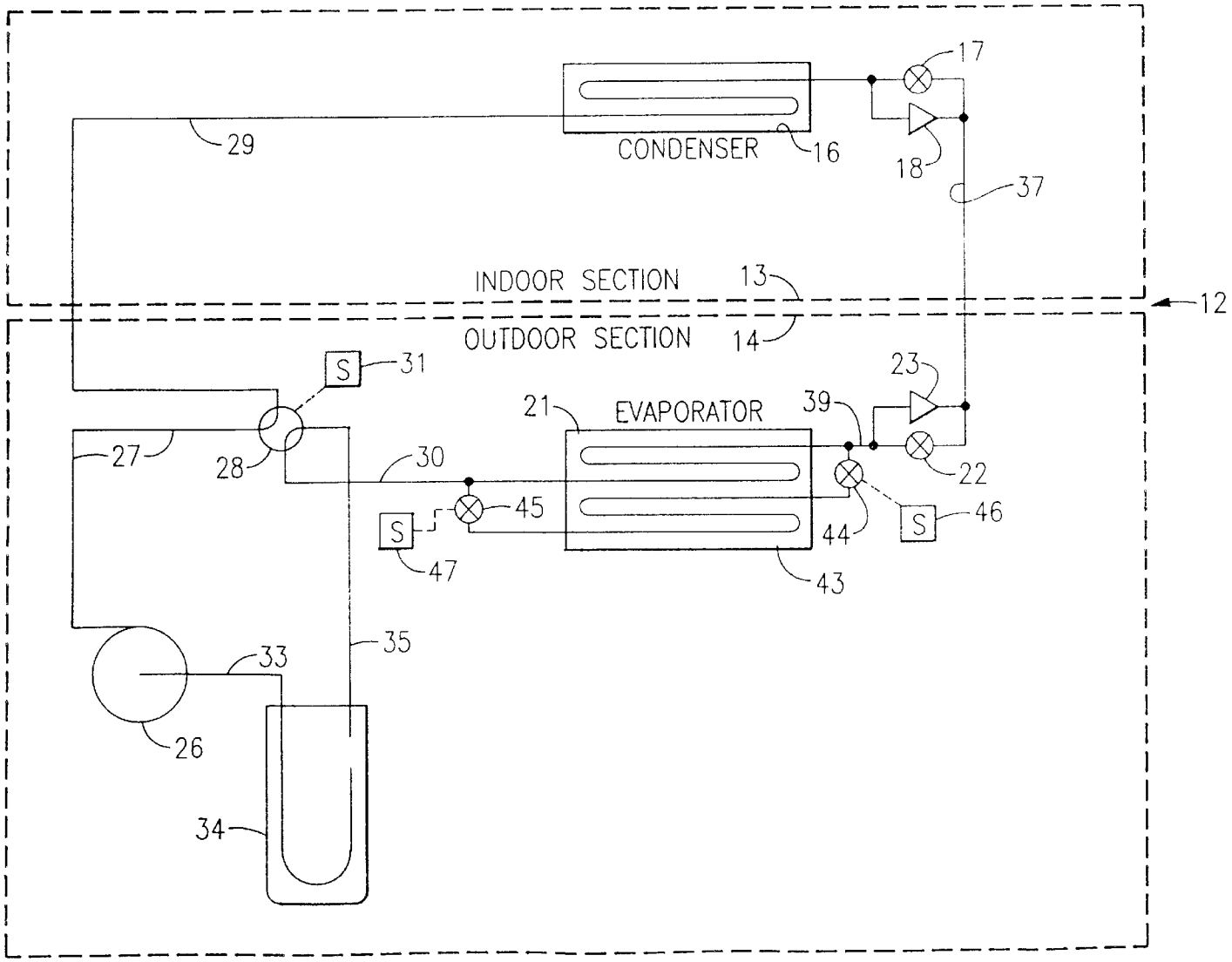
FIG. 1 is a schematic diagram of a bidirectional heat pump system in accordance with a first embodiment of the present invention.

Referring now to FIG. 1, a heat pump system 12 in accordance with the present invention includes an indoor section 13 and an outdoor section 14. The indoor section includes a conventional primary coil 16, a conventional expansion device, such as a valve 17, and a unidirectional flow device such as a check valve 18. The check valve 18 renders the expansion valve 17 inoperative except when the flow is anticlockwise in the indoor section. The outdoor section 14 includes a conventional primary coil 21, an expansion valve 22, a check valve 23, and a compressor 26 which is connected by a conduit 27 to a four-way valve 28. The valve 28 is positionable electrically or electronically, such as by a solenoid 31, so as to connect the conduit 27 through a conduit 29 to the coil 16 when the heat pump system is in a heating mode of operation as shown, or (in the other position) to connect the conduit 27 through a conduit 30 to the coil 21 during a cooling mode of operation. The compressor 26 may be any conventional piston or scroll or other type of compressor.

The compressor 26 is fed by a conduit 33 from a conventional suction accumulator 34, the input to which in conduit 35 may be from either coil 16 or coil 21 depending upon the position of the four-way valve 28. The accumulator 34 will have a conventional oil bleed (not shown) for slowly metering all of the liquid in the accumulator back to the compressor so as to recover compressor oil, without shocking the compressor.

In a heating mode of operation, the inlet of the expansion valve 22 is connected through the check valve 18 to the effluent of the coil 16 through a conduit 37, and the outlet of the valve 22 is connected to the coil 21 through a conduit 39. The invention is shown herein within a heat pump adjusted for a heating mode of operation, since the separation of the low pressure refrigerant component according to the invention is desired to increase system capacity during heating. The apparatus described thus far is conventional.

In accordance with the invention, the outside primary coil 21 is provided with a second section 43, either end of which can be connected to a corresponding end of the coil 21 by means of a corresponding valve 44, 45, each of which is operable electrically or electronically by any suitable means, such as a solenoid 46, 47. The coil section 43 is structured physically below the section 21 so as to tend to receive as much as possible of the liquid in the system that flows to the outside. Normally, switching from cooling to heating, and most particularly to heating of a sort which requires a higher capacity than normal air conditioning use requires, will take place in the fall of the year in the northern hemisphere. At some point when the system is turned off, following which a switch over to enhanced heating operation is to take place, both of the valves 44 and 45 will be open so that most of the liquid refrigerant will be stored in the coil 43. Then, when start up occurs, the valve 44 will be closed, and valve 45 will remain open. When the compressor is turned on, it will create a vacuum in the conduits 30, 35 and in the coil 43. The high pressure components of the refrigerant blend are more volatile, and will boil off the liquid that is in the coil 43, leaving the lower pressure component (less volatile) in the coil 43 in the form of liquid. When sufficient high pressure vapor has left the coil 43 to fully charge the system, the valve 45 is also closed, isolating the coil 43 completely from the system. The low pressure component of the blend is stored in the coil 43 until such time as a lower capacity blend is required again, such as when cooling may be required in the spring in the northern hemisphere. To return the blend to its original composition, all that is required is to open both of the valves 44, 45.

For the invention to operate properly, most of the liquid in the system must be in the coil 43 at the commencement of the separation operation which has just been described. This requires that: most of the liquid flow to the outdoor unit, the liquid will flow to the coil 43 rather than the coil 21, and that the coil 43 has adequate capacity to store a significant amount of the refrigerant of the system when it is in the form of liquid. In favor of the invention is the fact that liquid will naturally tend to migrate to the region of lowest pressure or temperature in the system. In the fall or early winter, when the switch to high pressure refrigerant is likely to be made, the outdoor unit will be colder, and hence have a lower pressure than the indoor unit, so most of the charge will tend to move to the outdoor side of the system when the system is not operating. Further, when the unit is operating in the heating mode as shown, the outdoor coil will act as the evaporator, and therefore will have the lowest temperature in the system. During the fall and early winter when the system is turned off after being in a heating mode utilizing the full blend, the temperature in the outdoor coil should remain lower than the indoor coil for some time, depending upon ambient conditions. All of the conduits should be arranged to drain outwardly to the outdoor section, if possible, and to drain particularly to the coil 43 in the outdoor section. If the lines between the indoor section and the outdoor section cannot be arranged to flow by gravity toward the outdoor section without pooling, such as where the indoor unit is mounted physically below the outdoor unit, the liquid in the indoor section should evaporate, due to its high temperature, and recondense in the outdoor section. Additionally, heating of the lines to avoid recondensation may be employed if necessary in any given case.

Figure 2:
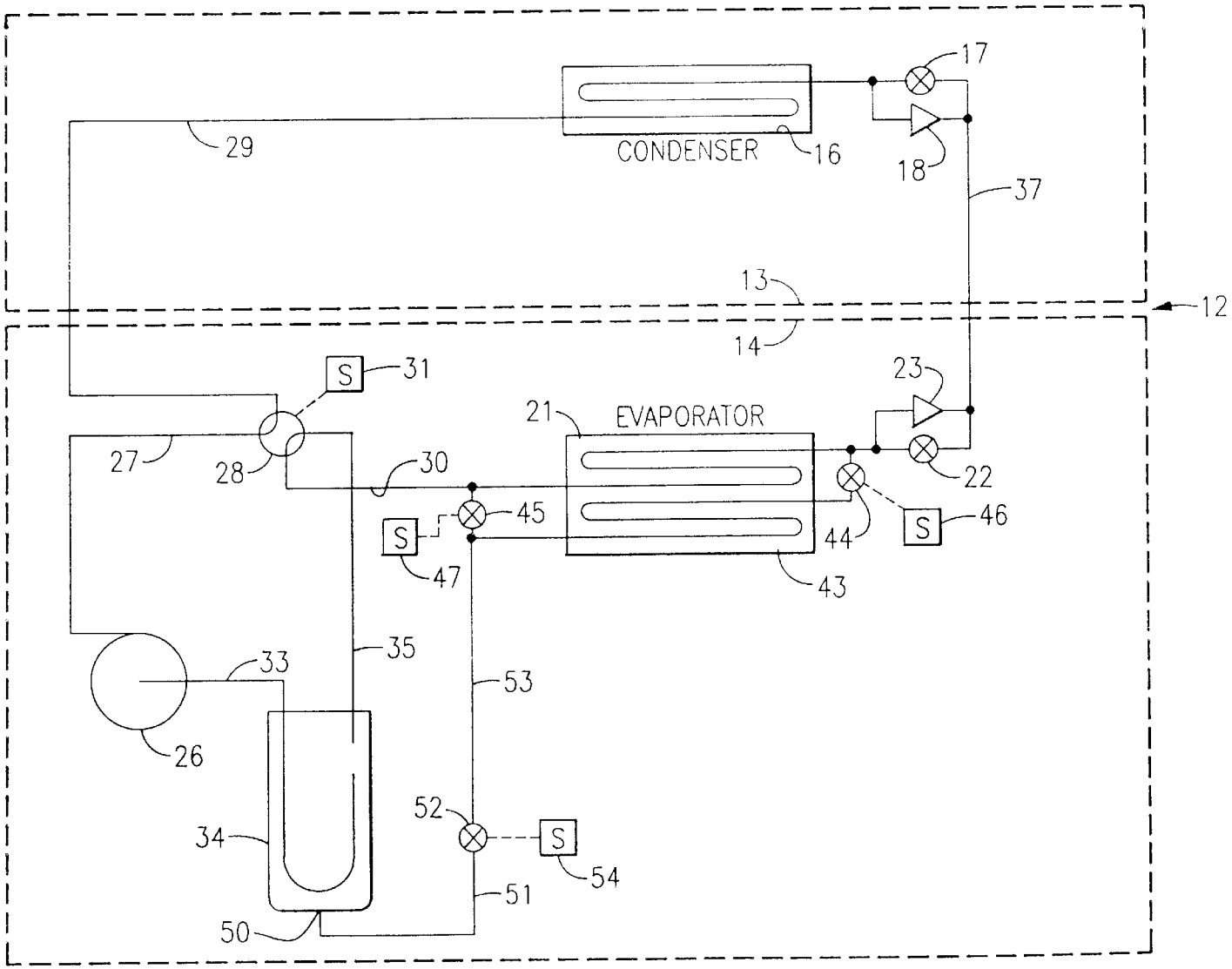
FIG. 2 is a schematic diagram of a bidirectional heat pump system in accordance with a second embodiment of the present invention.

If the coil 43 cannot be provided with adequate size to contain most of the system refrigerant when it is in the liquid phase, the modification of FIG. 2 may be utilized so as to employ the aid of the accumulator in the separation process. In FIG. 2, the accumulator 34 has, at its bottom, an additional liquid inlet 50 which is connected through a conduit 51, a valve 52 and a conduit 53 to the valve 45 at the outlet of the coil 43. The accumulator should be as low as the coil 43. The valve 52 is operated by any suitable electrical or electronic means, such as a solenoid 54. When the system is operating in a cooling mode, all three valves 44, 45, 52 are open; the valves remain open when the system is not operating. When separation of the low pressure component is required during start up of the heating mode, only valve 44 is closed, valves 45 and 52 remaining open. The compressor is fed through the conduit 33 by the high pressure vapor which boils off from the accumulator 34. During this process, liquid flows from the coil 43 through the valve 52 to the inlet 50, as well as vapor flowing through the valve 45 and the conduits 30 35 to the accumulator 34. When sufficient vapor has boiled off the accumulator (and the coil 43 to some extent) valves 45 and 52 are closed, and most of the low pressure component of the refrigerant is stored in the coil 43 in the liquid phase. This embodiment of the invention has the additional advantage of a larger boiling surface area within the accumulator, for more efficient separation; there is less of a tendency for liquid droplets to become entrained within the suction flow.

In the embodiment of FIGS. 1 and 2, even though the valve 44 is closed on startup, the vacuum applied to the coil 43 is not very good because fluid is flowing through the expansion valve 22. Thus, only about a 10% shift in coolant composition is achieved.

Figure 3:
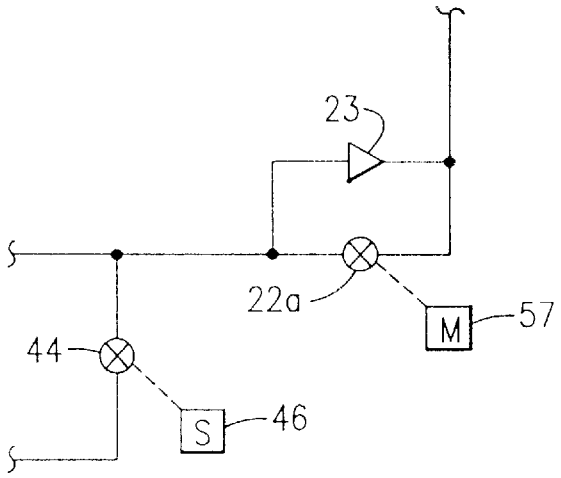
FIG. 3 is a fragmentary schematic diagram of a vacuum improving modification to the embodiments of FIGS. 1 and 2.

To overcome this, FIG. 3 illustrates a modification in which the expansion valve 22 is adjustable such as by a motor 57, so that it can be fully closed during startup, thereby to improve the vacuum. In this circumstance, a shift on the order of 20% can be achieved in the coolant composition.

Figure 4:
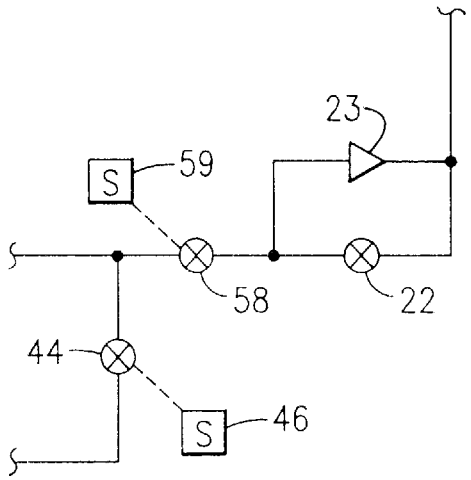
FIG. 4 is a fragmentary schematic diagram of an alternative vacuum improving modification to the embodiments of FIGS. 1 and 2.

If, in any embodiment, use of an adjustable expansion valve 22*a* is not desirable, a separate valve 58 operated by any suitable electrical or electronic means such as a solenoid 59 may be utilized as shown in FIG. 4. In FIG. 4, the path to the expansion valve 22 is simply closed off during startup. Choice of which modification, FIG. 3 or FIG. 4, is determined by the particular design characteristics of any system employing the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A heat pump system comprising:

an indoor primary coil;

an outdoor primary coil;

a compressor;

a suction accumulator feeding the input of said compressor;

means for alternatively directing a zeotropic multi-component refrigerant blend having a low pressure component from said compressor to said outdoor coil and from said indoor coil to said suction accumulator whereby said outdoor coil serves as a condenser, said indoor coil serves as an evaporator and the heat pump system operates in a cooling mode or for directing the refrigerant blend from said compressor to said indoor coil and from said outdoor coil to said suction accumulator whereby said indoor coil serves as a condenser and said outdoor coil serves as an evaporator and the heat pump system operates in a heating mode; and means for selectively expanding the refrigerant flowing from the one of said coils serving as condenser to the one of said coils serving as evaporator;

characterized by the improvement comprising:

said outdoor primary coil having two sections, a first one of said sections being in fluid communication with the directing means and the expanding means, the second of said two sections having shut off valves at both ends for selectively placing the second section in fluid communication with the directing means and the expanding means, respectively, said second section positioned below said first section, whereby the liquid refrigerant blend migrates to the second section when the system is inoperative and said shut off valves are open, and whereby a component of the refrigerant blend other than a low-pressure component is removed from said second section by vacuum separation when said system is operating in a heating mode with the second section in fluid communication with the directing means by opening said shut-off valve closest to the inlet of the suction accumulator and closing the other shut-off valve.

2. A system according to claim 1 further comprising:

means, operative when said system is operating with said second section in fluid communication with said directing means and the other of said shutoff valves is closed, to prevent the flow of fluid to said expanding means.

3. A system according to claim 1 wherein said expanding means is adjustable and further comprising:

means for totally closing off said expanding means when said system is operating with said section in fluid communication with said directing means and the other of said shutoff valves is closed.

4. A system according to claim 1 further comprising:

a liquid inlet at the base of said accumulator connected through a third shut off valve to selectively permit said liquid inlet to be in fluid communication with said directing means, whereby liquid refrigerant also migrates through said liquid inlet into said accumulator when said system is inoperative with said third shut off valve open, and refrigerant is removed from said accumulator by vacuum separation when said system is operated with said third shut off valve open.

5. A method of operating a heat pump system having an indoor primary coil, an outdoor primary coil, a compressor, a suction accumulator feeding the input of said compressor, and means for expanding the refrigerant flowing between said primary coils, comprising:

providing said outdoor coil with two sections, a first one of said sections being in fluid communication within said system at all times, the second one of said sections being disposed lower than said first section and having shut off valves that selectively connect either end to a corresponding end of said first section and said system;

charging said system, with said shut off valves open, with a zeotropic multi-component refrigerant blend having a low pressure component;

operating said system in a cooling mode with both of said shutoff valves open, whereby to utilize all of said blend;

causing said system to be inoperative with both of said shutoff valves open, whereby said refrigerant migrates in liquid form into said second section;

adjusting said system to operate in a heating mode with the one of said shut off valves in closest communication with the inlet of said suction accumulator open and the other shut off valve closed, whereby the portion of said blend other than said low pressure component will vaporize and separate from said low pressure component, thereby increasing the capacity of said system.

6. A method according to claim 5 wherein said adjusting step further comprises blocking flow through said expansion means when said other shutoff valve is closed.

7. A method according to claim 5 further comprising:

providing a liquid inlet to said suction accumulator in fluid communication through a shut off valve to the outlet of said second section when said system is inoperative or operating in a heating mode, whereby refrigerant also migrates to said accumulator when said system is inoperative and is removed from said accumulator by vacuum separation when said system is operating in a heating mode.

* * * * *